US008066074B2

(12) United States Patent
Maskos et al.

(10) Patent No.: US 8,066,074 B2
(45) Date of Patent: Nov. 29, 2011

(54) SYSTEMS AND METHODS FOR MITIGATING ANNULAR PRESSURE BUILDUP IN AN OIL OR GAS WELL

(75) Inventors: Krystian K. Maskos, Houston, TX (US); Michael R. French, Katy, TX (US)

(73) Assignee: Chevron U.S.A. Inc., San Ramon, CA (US)

( * ) Notice: Subject to any disclaimer, the term of this patent is extended or adjusted under 35 U.S.C. 154(b) by 58 days.

(21) Appl. No.: 12/272,924

(22) Filed: Nov. 18, 2008

(65) Prior Publication Data

US 2010/0122811 A1 May 20, 2010

(51) Int. Cl.
*E21B 34/08* (2006.01)

(52) U.S. Cl. ..... 166/324; 166/364

(58) Field of Classification Search ..... 166/363, 166/364, 163, 164, 373
See application file for complete search history.

(56) References Cited

U.S. PATENT DOCUMENTS 3,457,864 A * 7/1969 Price ..... 417/44.2
4,109,725 A 8/1978 Williamson et al.
4,576,235 A 3/1986 Slaughter et al.
4,732,211 A 3/1988 Haugen et al.
4,877,542 A 10/1989 Lon et al.
5,259,456 A * 11/1993 Edwards et al. ..... 166/319
5,707,176 A * 1/1998 Okubo ..... 405/184
5,947,206 A * 9/1999 McCalvin et al. ..... 166/324
6,293,346 B1 * 9/2001 Patel ..... 166/373
6,457,528 B1 10/2002 Staudt
7,096,944 B2 8/2006 Vargo et al.
7,191,830 B2 * 3/2007 McVay et al. ..... 166/242.1
7,207,603 B2 4/2007 Segreto
2004/0238178 A1 * 12/2004 Laureano et al. ..... 166/368
2006/0196539 A1 * 9/2006 Raska et al. ..... 137/68.24
2006/0243435 A1 11/2006 Faul et al.
2007/0114033 A1 5/2007 Hermes et al.

OTHER PUBLICATIONS

PCT International Search Report dated Apr. 30, 2010; PCT International Application No. PCT/US2009/064828.

* cited by examiner

*Primary Examiner* — Shane Bomar
*Assistant Examiner* — Kipp Wallace
(74) *Attorney, Agent, or Firm* — Edward Mickelson

(57) ABSTRACT

The present invention is embodied in systems and methods for mitigating temperature-related pressure buildup in the trapped annulus of an oil or gas well, wherein such systems and methods employ production and/or tieback casing having one or more pressure mitigating chambers, and wherein such chambers make use of pistons, valves, and burst disks to mitigate pressure increases within the annulus.

13 Claims, 3 Drawing Sheets

SYSTEMS AND METHODS FOR MITIGATING ANNULAR PRESSURE BUILDUP IN AN OIL OR GAS WELL

FIELD OF THE INVENTION

This invention relates generally to mitigation of temperature-related pressure buildup in the trapped annulus of an oil or gas well, and specifically to systems and methods for mitigating such annular pressure buildup, wherein such systems and methods typically employ production and/or tieback casing having one or more pressure mitigating chambers.

BACKGROUND

Problems arise when fluids trapped in the casing/casing annulus of an oil or gas well expand when heated as a result of production of hot fluids from the producing horizon into the wellbore. This expansion results in buildup of pressure in the annulus if no effort is undertaken to vent or otherwise mitigate the pressure buildup. This situation is commonly referred to as "annular pressure buildup (APB)," and it can result in either collapse of the inner casing string or burst of the outer casing string. Either of these conditions (burst or collapse) could potentially compromise the mechanical integrity of the oil or gas well. Over the years, a number of methods have been developed to address APB.

Vacuum insulated tubing (VIT) has been utilized to limit the transfer of heat from the wellbore to the fluids in the trapped casing/casing annulus, thereby serving to prevent deleterious APB. See, e.g., Segreto, U.S. Pat. No. 7,207,603.

Some APB mitigation efforts have involved placement of a compressible fluid, such as nitrogen ($N_2$), in the trapped annulus during the cement job to limit the pressure buildup associated with expansion of the trapped fluid. See, e.g., Williamson et al., U.S. Pat. No. 4,109,725. While such methods can help limit the pressure in the annulus by liquefying the compressible fluid, the resulting pressures can still be quite high.

Insulating fluid/gel has been placed in the tubing/casing annulus in an effort to limit the transfer of heat due to convection from the wellbore to the fluids in the trapped casing/casing annuls. Methods utilizing such insulating fluid/gel effect APB mitigation in a manner similar to those employing VIT. See, e.g., Lon et al., U.S. Pat. No. 4,877,542.

In some instances, APB mitigation efforts have involved strapping a compressible solid material, such as foam or hollow particles, to the outside of the inner casing string to accommodate expansion of the fluids in the annulus by effectively "increasing" the volume in the annulus as the solid material compresses. See, e.g., Vargo et al., U.S. Pat. No. 7,096,944.

Another strategy for mitigating APB is to place a fluid or other material in the annulus that will "shrink" when activated due to heat and/or time. See, e.g., Hermes et al., United States Patent Application Publication No. 20070114033 A1, wherein methyl methacrylate is so used.

Burst and/or collapse disks have been employed to act as a pressure relief means and to allow the heated fluid in the annulus to "vent" through the disc. See, e.g., Staudt, U.S. Pat. No. 6,457,528.

In yet another APB mitigation technique, one can drill a hole in the outer casing string and allow the fluids to vent through the hole or via a pressure relief device placed in the hole. See, e.g., Haugen et al., U.S. Pat. No. 4,732,211.

Despite the variety of APB mitigation techniques described above, APB remains a serious problem—particularly for subsea operations. Accordingly, methods and systems that can better/further mitigate APB, either by themselves or in concert with one or more of the above-described techniques, would be particularly beneficial—particularly wherein such methods and systems can mitigate APB in subsea operations, and especially in deepwater operations.

BRIEF DESCRIPTION OF THE INVENTION

Embodiments of the present invention are generally directed to systems and methods for mitigating temperature-related pressure buildup in the trapped annulus of an oil or gas well, often wherein such systems and methods employ production and/or tieback casing having one or more pressure mitigating chambers, and wherein such chambers are typically integrated into/with one or more of said casing strings, e.g., as a joint and/or other coupling. In some embodiments, such systems and methods can be advantageously utilized in offshore (e.g., deepwater) wells.

In some embodiments, the present invention is directed to one or more systems for mitigating pressure buildup in a wellbore casing annulus, said systems comprising: (a) one or more regions of annular space established by at least two casing strings having different diameters and arranged in a nested, concentric manner such that at least a portion of a smaller diameter casing string is situated in at least a portion of a larger diameter casing string; (b) at least one chamber that is integrated with a casing joint on at least one of the casing strings, wherein the at least one chamber contains an inert gas, and wherein said gas is introduced to said chamber via a gas fill port that is integrated with said chamber; and (c) at least one piston-containing piston assembly integrated with the at least one chamber such that annular liquid present in an annular region can, when increased in pressure, access the at least one chamber via an annular pressure buildup port, so as to move the piston in such a way as to increase pressure of the inert gas in the chamber and decrease, via expansion, pressure of the annular liquid. In some embodiments, such system(s) further comprise one or more chambers of a second type, wherein said chambers incorporate one or more burst disks separating the chamber from the annular space.

In some embodiments, the present invention is directed to one or more methods for mitigating pressure buildup in a wellbore casing annulus, said method(s) comprising the steps of: (a) providing a chamber in a wellbore casing annulus, wherein the chamber is integrated via a casing joint on at least one casing string, and wherein said chamber comprises an integrated piston; (b) introducing/establishing a quantity of inert gas into/in said chamber; (c) allowing the piston to move, in response to a change in pressure in the wellbore casing annulus, so as to equilibrate pressure between the chamber and the wellbore casing annulus, thereby serving to mitigate annular pressure buildup in said wellbore. In some embodiments, such method(s) further comprise deployment of a chamber of a second type, wherein said chamber incorporates one or more burst disks separating the chamber from the annular space.

The foregoing has outlined rather broadly the features of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

1. Introduction

This invention is generally directed to systems and methods for mitigating temperature-related pressure buildup (APB) in the trapped annulus of an oil or gas well, wherein such systems and methods employ annular pressure buildup chambers, typically integrated with casing tubulars (e.g., production and/or tieback casing), and wherein such chambers make use of pistons, valves, and burst disks to mitigate pressure increases within the annulus. Such systems and methods can provide advantages over the prior art, particularly with respect to offshore (e.g., deepwater) wells.

2. Definitions

Certain terms are defined throughout this description as they are first used, while certain other terms used in this description are defined below:

A "wellbore," as defined herein, refers to a hole drilled into a geologic formation for the purpose of extracting a petroleum resource such as oil and/or gas. Such wellbores can be land-based, or they can reside off-shore (subsea). "Deepwater" off-shore wells are generally those in ten-thousand or more feet of water.

"Casing," as defined herein, generally refers to tubulars used in the completion of an oil and/or gas well. The term "casing string" will refer to any one of potentially numerous tubulars making up the casing or tubular assembly, and wherein such casing strings can be of the production and/or tie-back variety.

"Annular space," as defined herein, refers to the region, void, and/or volume bounded by two adjacent concentric casing strings in the casing assembly.

"Annular liquid," as described herein, refers to that liquid residing, or otherwise occupying, the annular regions of a wellbore. Sources of such liquid include, but are not limited to, drilling fluids, production fluids, formation fluids, and combinations thereof.

"Annular pressure," as defined herein, refers to the hydrostatic pressure of liquid in the annular space.

3. Systems

Figure 1:
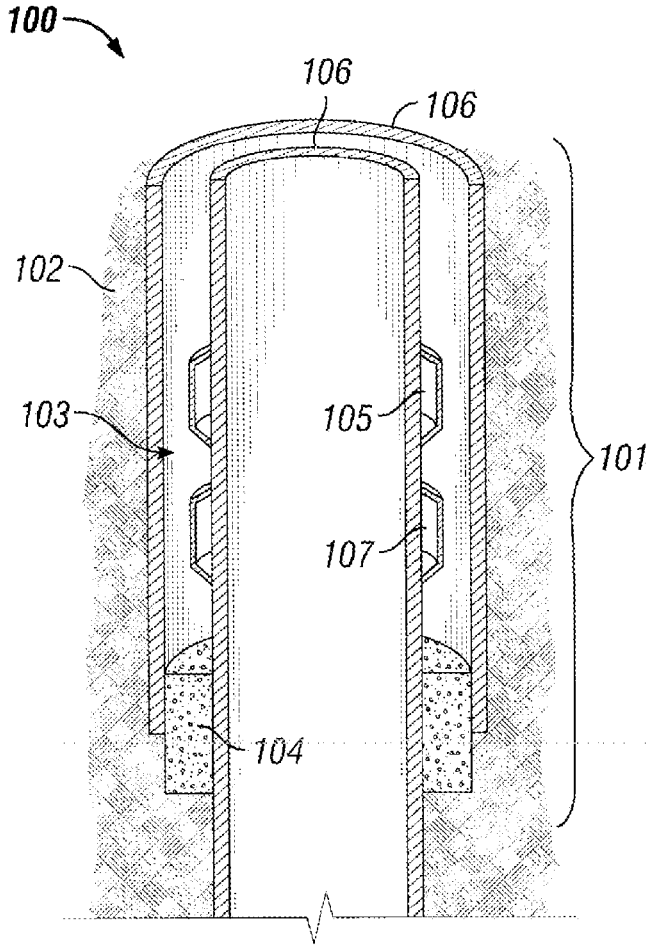
FIG. 1 schematically-depicts a system for mitigating annular pressure, in accordance with some embodiments of the present invention.

Referring to FIG. 1, in some embodiments, the present invention is directed to one or more systems 100 for mitigating pressure buildup in a wellbore casing annulus, wherein wellbore 101 is established in formation 102, said systems comprising: one or more regions of annular space 103 established by at least two casing strings 106 having different diameters and arranged in a nested, concentric manner such that at least a portion of a smaller diameter casing string is situated in at least a portion of a larger diameter casing string, and further defined and/or established by one or more cement plugs 104; (b) at least one chamber 105 (chamber of a first type) that is integrated with a casing joint on at least one of the casing strings, wherein the at least one chamber contains an inert gas, and wherein said gas is introduced to said chamber via a gas fill port (not shown) that is integrated with said chamber; and (c) at least one piston-containing piston assembly (not shown) integrated with the at least one chamber such that annular liquid present in an annular region can, when increased in pressure, access the at least one chamber via an annular pressure buildup (APB) port (not shown), so as to move the piston in such a way as to increase pressure of the inert gas in the chamber and decrease, via expansion, pressure of the annular liquid. In some embodiments, such system(s) further comprise one or more chambers 107 of a second type, wherein said chambers incorporate one or more burst disks (not shown) separating the chamber from the annular space.

Figure 2A:
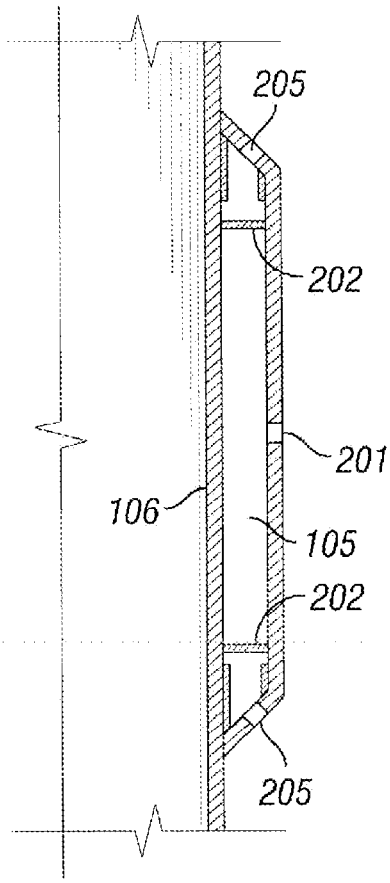
FIG. 2A illustrates an annular pressure mitigation chamber of the first configuration, in accordance with some embodiments of the present invention.
Figure 2B:
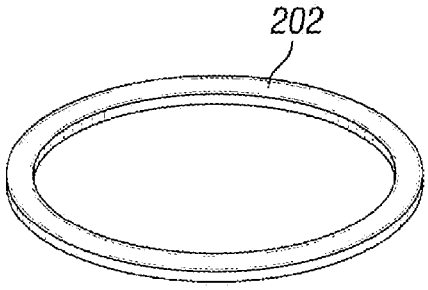
FIG. 2B illustrates piston 202.
Figure 3A:
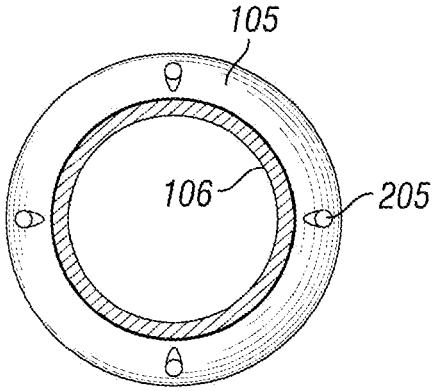
FIGS. 3A illustrates, in plain view, how an annular pressure mitigation chamber can be integrated with a casing string, in accordance with some embodiments of the present invention.
Figure 3B:
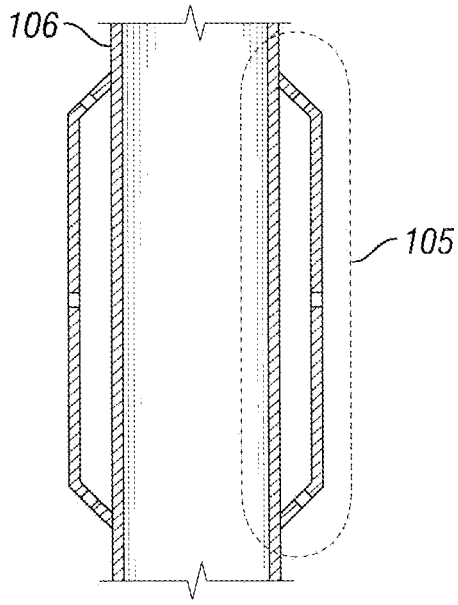
FIG. 3B illustrates, in a cutaway side view, how an annular pressure Mitigation chamber can be integrated with a casing string, in accordance with some embodiments of the present invention.

Referring now to FIG. 2A and 2B, shown is a more detailed cutaway (side view) of annular pressure mitigation chamber 105. In this illustrated embodiment, chamber 105 is established (i.e., integrated) with casing string 106. Chamber 105 is filled with an inert gas (e.g., $N_2$) via fill port 201, and annular pressure within the wellbore is regulated by piston(s) 202 (shown more clearly in FIG. 2B) and APB port(s) 205. FIGS. 3A and 3B further depict how chamber 105 can be integrated with a casing string, in accordance with some embodiments of the present invention, wherein FIGS. 3A and 3B depict plan and side views, respectively. In some such embodiments, such integration can be accomplished via the attachment of a larger diameter "shroud casing" to the outside of a smaller diameter production/tieback casing, where the ends are enclosed via a weldment or via end caps with seals.

Figure 4A:
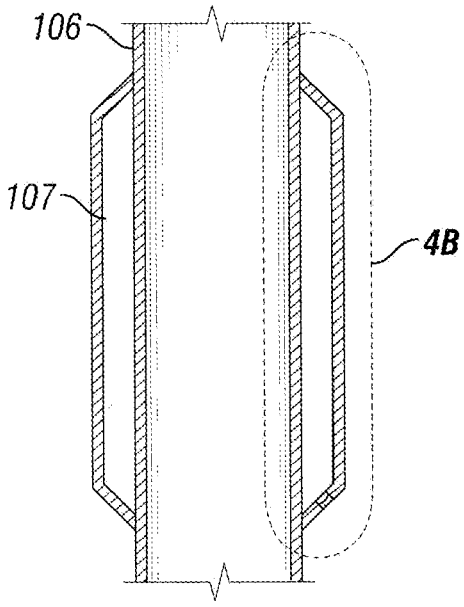
FIG. 4A illustrates an annular pressure mitigation chamber of the second configuration, in accordance with some embodiments of the present invention.
Figure 4B:
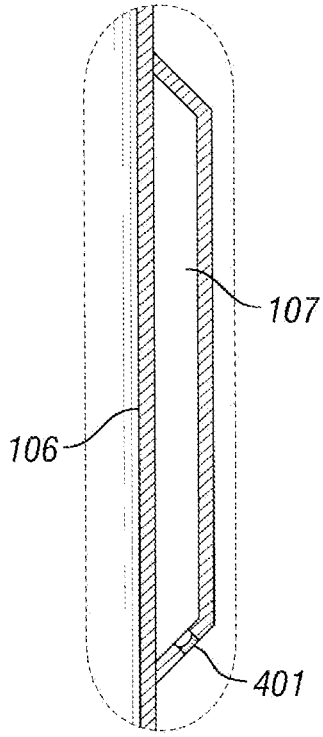
FIG. 4B better illustrates the circled region of FIG. 4A.

FIGS. 4A and 4B depict an APB mitigation chamber of a second type (107), established as an integral part of casing string 106 (e.g., via a joint), wherein said chamber is actuated via burst disk 401 (shown in FIG. 4B in greater detail), in accordance with some embodiments of the present invention, whereby the burst disk is designed to rupture with a temperature-induced pressure increase in the annular space. In some such embodiments, burst disk 401, or the channel to the chamber for which it controls access, can be used as a fill port, in accordance with some embodiments of the present invention. In some such embodiments, the burst disk ruptures at an annular pressure of at least about 2500 psi. Those of skill in the art will, however, appreciate that it is the combination of the burst disk's mechanical attributes, together with the pressure differential between the annular space and the chambers, which collectively contribute to the rupture of the burst disk.

In some such above-described system embodiments, the at least two casing strings are selected from the group consisting of production casing, tieback casing, and combinations thereof. In a typical casing assembly, multiple casing strings are employed, and one or more APB mitigation chambers of a first and/or second type can be disposed into one or more of the potentially multiple annular regions so formed. Those of skill in the art will recognize that not all annular regions in a well must be in fluid communication with each other.

In some such above-described system embodiments, any of the at least one chambers of a first type each comprise a volume of between 0.10 bbl (1 bbl=42 gal=159 liters) and 20 bbl. In some such above-described system embodiments, any of the at least one chambers of a second type each comprise a volume of between 0.10 bbl and 20 bbl. Total chamber volume is not particularly limited, as multiple chambers (of either type) can be employed within a single well.

In some such above-described system embodiments, the inert gas contained within the chamber is at vacuum pressures (e.g., less than 1 atm) under standard conditions. In other embodiments, the inert gas contained within said chamber is supra-atmospheric up to 6000 psi or greater. When multiple such chambers are employed, the pressure of the chambers can be different so as to tailor an engineered response to APB within the well in which they reside. In some or other such embodiments, the inert gas is selected from the group consisting of $N_2$, Ar, He, and combinations thereof.

In some such above-described system embodiments, wherein the at least one chamber of a second type comprises a vacuum of less than 1 atm. In some or other such embodiments, the at least one chamber of a second type comprises an inert gas. In some or other such embodiments, said chamber of a second type comprises an inert gas at a pressure up to about 6000 psi or greater.

In some such above-described system embodiments, a predetermined pressure inside the at least one chamber is used to control the pressure in the annular space. Control of annular pressure is annular pressure regulation and can be employed concurrently with annular pressure mitigation methods and systems.

In some such above-described system embodiments, such systems further comprise a means of changing, in situ, the amount of inert gas contained within at least one of said at least one chamber. In such systems, it is contemplated that a means of pressurizing/venting is employed so as to vary the pressure of such chambers downhole.

The annular pressure buildup port separates annular fluid from the piston or piston assembly. Such ports can incorporate a diaphragm of sorts, or they can merely serve as an access point. In some such above-described system embodiments, the annular pressure buildup port comprises a flow control means selected from the group consisting of a burst disk, a check valve, a directional valve, a flow control valve, and combinations thereof.

4. Methods

Method embodiments of the present invention are generally consistent with the system embodiments described above. In large part, they are process representations of such systems.

Figure 5:
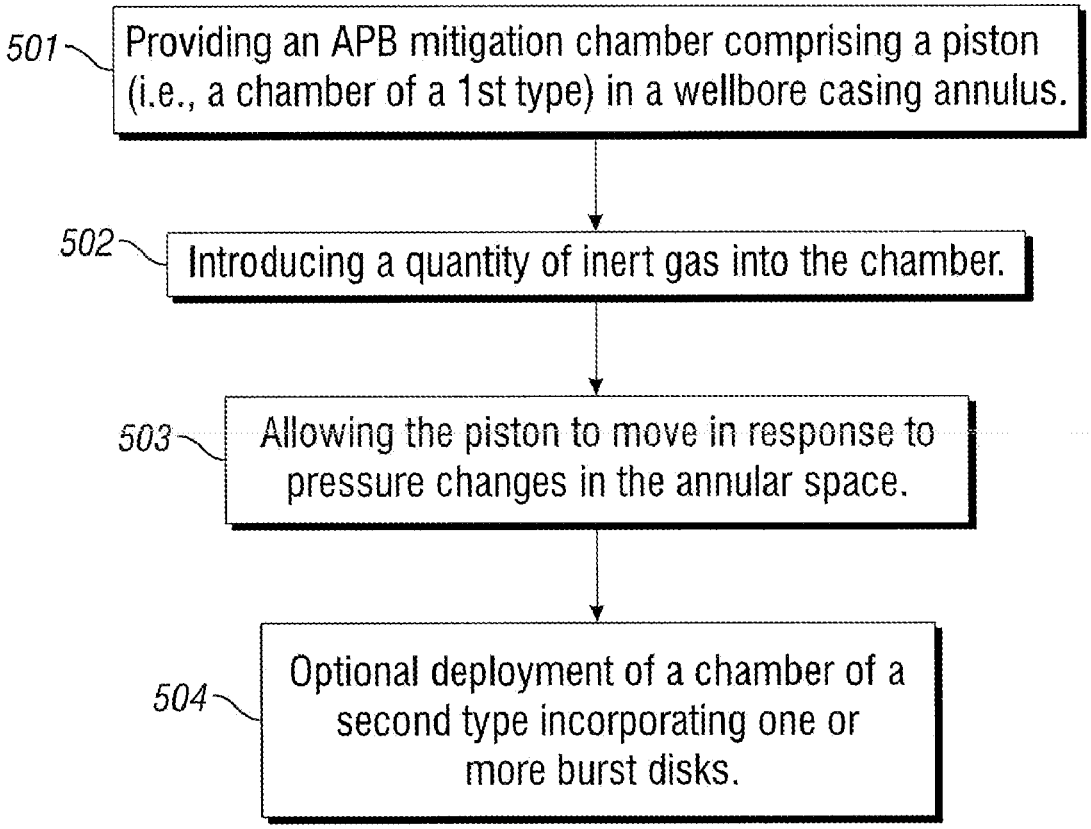
FIG. 5 depicts, in step-wise fashion, a method embodiment of the present.

Referring to FIG. 5, in some embodiments, the present invention is directed to one or more methods for mitigating pressure buildup in a wellbore casing annulus, said method(s) comprising the steps of: (Step 501) providing a chamber in a wellbore casing annulus, wherein the chamber is integrated via a casing joint on at least one casing string, and wherein said chamber comprises an integrated piston; (Step 502) introducing a quantity of inert gas to said chamber; (Step 503) allowing the piston to move, in response to a change in pressure in the wellbore casing annulus, so as to equilibrate pressure between the chamber and the wellbore casing annulus, thereby serving to mitigate annular pressure buildup in said wellbore. In some embodiments, such method(s) further comprise deployment of a chamber of a second type, wherein said chamber incorporates one or more burst disks separating the chamber from the annular space.

In some such above-described method embodiments, the chambers of the first and/or second type(s) contain an inert gas selected from the group consisting of $N_2$, Ar, He, and combinations thereof. Said inert gas can be at a pressure of less than 1 atm to 6000 psi or greater.

In some such above-described method embodiments, there further comprises a step of changing, via controlled alteration, the amount of inert gas in the chamber of a first type, so as to provide control over the pressure in the annular space. In some such embodiments, the one or more burst disks associated with the chamber of the second type are engineered to burst at an annular pressure of 2500 psi.

In some such above-described method embodiments, multiple chambers (of a first type) are employed to mitigate annular pressure build up in a wellbore. In some such above-described method embodiments, multiple chambers of a second type are employed to mitigate annular pressure build up in a wellbore. In some or still other such embodiments, such multiple chambers (of either type) can function to regulate pressure in the annular regions of said wellbore.

In some embodiments, the annular pressure buildup port functions simply as a point of access for which the annular liquid can access the chamber piston/piston assembly. In some such above-described method embodiments, an annular pressure buildup port is employed to regulate fluid communication between the piston and annular liquid residing in the annular space.

5. Variations

Variations (i.e., alternate embodiments) on the above-described systems and methods include applications directed primarily to annular pressure regulation, instead of being primarily directed to annular pressure buildup mitigation. Additionally, such methods and systems need not be restricted to oil and gas wells. Those of skill in the art will recognize that such systems and methods may find applicability in any tubular assembly comprising fluid-filled annular space that is subject to increases in pressure.

6. Example

The following example serves to illustrate a deepwater project for which such APB mitigation systems/methods of the present invention could find applicability, and it is provided to demonstrate particular embodiments of the present invention. It should be appreciated by those of skill in the art that the methods disclosed in the example which follows merely represent exemplary embodiments of the present invention. However, those of skill in the art should, in light of the present disclosure, appreciate that many changes can be made in the specific embodiments described and still obtain a like or similar result without departing from the spirit and scope of the present invention.

An exemplary application for systems/methods of the present invention involve APB issues associated with Chevron's Tahiti project. The Tahiti wells require 10¾" tieback casing. Upon installation of the tieback casing in the Tahiti wells, a trapped annulus is created by the 10¾" tieback casing and the 20"×16" surface/intermediate casing annulus. Trapped pressure in this annulus could be mitigated by installing 10¾" tieback casing with 13⅝ shrouded casing, forming an annular pressure mitigation chamber (APMC). Calculations were performed and it was determined that approximately 10 bbls of additional volume created by the APMC would be required to mitigate against annular pressure buildup in a typical Tahiti well. This 10 bbls of additional volume could be achieved by running 10 joints of 10¾" tieback casing with the shrouded 13⅝" casing and associated APMC. The 13⅝" shrouded casing would be 30' in length, leaving sufficient tong/slip/elevator space for handling the 10¾" casing on each end.

7. Conclusion

In summary, this invention is directed to systems and methods for mitigating and/or regulating temperature-related annular pressure buildup in an oil or gas well, wherein such systems and methods employ integrated annular pressure buildup chambers, and wherein such chambers make use of pistons, valves, and burst disks to mitigate pressure increases within the annulus. Such systems and methods can provide advantages over the prior art, particularly with respect to offshore (e.g., deepwater) wells.

All patents and publications referenced herein are hereby incorporated by reference to the extent not inconsistent herewith. It will be understood that certain of the above-described structures, functions, and operations of the above-described embodiments are not necessary to practice the present invention and are included in the description simply for completeness of an exemplary embodiment or embodiments. In addition, it will be understood that specific structures, functions, and operations set forth in the above-described referenced patents and publications can be practiced in conjunction with the present invention, but they are not essential to its practice. It is therefore to be understood that the invention may be practiced otherwise than as specifically described without actually departing from the spirit and scope of the present invention as defined by the appended claims.

What is claimed:

1. A system for mitigating pressure buildup in a wellbore casing annulus of an oil or gas well, said system comprising:

a) one or more regions of annular space within the oil or gas well established by at least two casing strings having different diameters and arranged in a nested, concentric manner such that at least a portion of a smaller diameter casing string is situated in at least a portion of a larger diameter casing string;

b) at least one chamber that is integrated with a casing joint on at least one of the casing strings, wherein the at least one chamber contains an inert gas, and wherein said gas is introduced to said chamber via a gas fill port that is integrated with said chamber; and c) at least one piston-containing piston assembly integrated with the at least one chamber such that annular liquid present in an annular region can, when increased in pressure, access the at least one chamber via an annular pressure buildup port, so as to move the piston in such a way as to increase pressure of the inert gas in the chamber and decrease, via expansion, pressure of the annular liquid wherein said system further comprises one or more chambers of a second type, wherein said chambers incorporate one or more burst disks separating the chamber from the annular space.

2. The system of claim 1, wherein the burst disk ruptures at a pressure of at least about 2500 psi.

3. The system of claim 1, wherein the at least two casing strings are selected from the group consisting of production casing, tieback casing, and combinations thereof.

4. The system of claim 1, wherein the at least one chambers of a first type comprise a volume of between 0.10 bbl and 20 bbl.

5. The system of claim 1, wherein the at least one chambers of a second type comprise a volume of between 0.10 bbl and 20 bbl.

6. The system of claim 1, wherein the inert gas is selected from the group consisting of $N_2$, Ar, He, and combinations thereof.

7. The system of claim 1, wherein the at least one chamber of a second type comprises a vacuum of less than 0.5 atm.

8. The system of claim 1, wherein the at least one chamber of a second type comprises an inert gas.

9. A method for mitigating pressure buildup in a wellbore casing annulus of an oil or gas well, said method comprising the steps of:

a) providing a chamber in the wellbore casing annulus of the oil or gas well, wherein the chamber is integrated via a casing joint on at least one casing string, and wherein said chamber comprises an integrated piston;

b) introducing a quantity of inert gas to said chamber;

c) allowing the piston to move, in response to a change in pressure in the wellbore casing annulus, so as to equilibrate pressure between the chamber and the wellbore casing annulus, thereby serving to mitigate annular pressure buildup in said wellbore, said method further comprising a step of deploying, via casing integration, a chamber of a second type, wherein said chamber incorporates one or more burst disks separating the chamber from the annular space.

10. The method of claim 9, wherein the chamber of a second type contains an inert gas selected from the group consisting of $N_2$, Ar, He, and combinations thereof.

11. The method of claim 9, further comprising a step of changing, via controlled alteration, the amount of inert gas in the chamber of a first type, so as to provide control over the pressure in the annular space.

12. The method of claim 9, wherein the one or more burst disks associated with the chamber of the second type are engineered to burst at an annular pressure of 2500 psi.

13. The method of claim 9, wherein multiple chambers of a second type are employed to mitigate annular pressure build up in a wellbore.

* * * * *